United States Patent [19]

Böehn et al.

[11] 4,153,742

[45] May 8, 1979

[54] MANUFACTURE OF ELECTRODES

[75] Inventors: Hugo Böehn; Wolfram Treptow, both of Ludwigshafen; Gerd Wunsch, Speyer; Volker Kiener, Weisenheim; Hermann Meyer, Frankenthal; Gotthard Csizi, Bad Durkheim, all of Fed. Rep. of Germany

[73] Assignee: BASF Aktiengesellschaft, Ludwigshafen, Fed. Rep. of Germany

[21] Appl. No.: 813,972

[22] Filed: Jul. 8, 1977

[30] Foreign Application Priority Data

Aug. 25, 1976 [DE] Fed. Rep. of Germany ..... 2638218

[51] Int. Cl.[2] ..... B05D 5/12

[52] U.S. Cl. ..... 427/126; 427/327; 204/290 F

[58] Field of Search ..... 204/29, 32 R, 40, 290 F; 427/126, 327, 328

[56] References Cited

U.S. PATENT DOCUMENTS

| | | | |
|---|---|---|---|
| 2,801,213 | 7/1957 | Beuckman et al. | 427/328 |
| 3,617,462 | 11/1971 | DeWitt | 204/290 F |

FOREIGN PATENT DOCUMENTS

| | | | |
|---|---|---|---|
| 815572 | 7/1959 | United Kingdom | 204/32 R |

OTHER PUBLICATIONS

Silman; Chemical and Electro-Plated Finishes; Chapman and Hall, Ltd.; London; 1952, p. 161.

*Primary Examiner*—John H. Mack
*Assistant Examiner*—William Leader
*Attorney, Agent, or Firm*—Keil & Witherspoon

[57] ABSTRACT

Manufacture of electrodes consisting of bases of valve metals with electrochemically active coatings applied thereto. The electrodes are pre-treated before the said coatings are applied, the pre-treatment comprising treating the base with hydrogen.

3 Claims, No Drawings

MANUFACTURE OF ELECTRODES

The present invention relates to a process for the pre-treatment of electrode bases consisting of a valve metal, also described as a film-forming metal, onto which an electrochemically active coating is subsequently to be applied.

Valve metals, such as the elements of sub-group IV and V of the periodic table, eg. titanium, zirconium, hafnium, vanadium, niobium, tantalum or their alloys with one another, are extensively employed as electrode base materials, because of their good resistance to corrosion. Since, however, they do not conduct current in the cathode direction, they have to be provided with an electrochemically active coating which, for example according to German Published Application DAS No. 1,671,422, consists of an oxide, carbide, nitride or sulfide of palladium, platinum, rhodium, iridium, ruthenium or osmium and of at least one oxide of a film-forming metal. Electrodes in which the electrochemically active coating consists of manganese dioxide or of mixtures of manganese oxide with lead dioxide or vanadium pentoxide, are also becoming of increasing interest.

Before the base is coated, it must be pre-treated. This pretreatment consists (German Published Application DAS No. 1,571,721) essentially in first carrying out a mechanical cleaning and degreasing, with or without a treatment with an oxidizing acid. Thereafter, the base must additionally be treated with non-oxidizing acids, eg. hydrofluoric acid, hydrochloric acid, oxalic acid or tartaric acid, in order to influence its surface character. Only then can the base be provided with the electrochemically active coating, if necessary after first applying a protective layer.

It is an object of the present invention to provide electrodes which have an increased life and improved electrochemical behavior and which consist of bases of valve metals, with electrochemically active coatings applied thereon.

We have found that this object is achieved if the base is treated with hydrogen before applying the electrochemically active coating.

The process according to the invention may be carried out as follows: the base consisting of valve metal is introduced into a hydrogen atmosphere, if appropriate after first having been cleaned mechanically by means of brushes, sand-blasting and the like, and having been pickled, eg. with hydrofluoric acid or oxalic acid. The treatment with hydrogen may be carried out at room temperature (20° C.) or at elevated temperatures. The duration of the treatment depends on the temperature and may be varied within the range of from about 20 minutes to 2 hours; for a given effect, the duration of the treatment may be the shorter, the higher is the temperature. Advantageously, the treatment is carried out at above 100° C. and up to 500° C. Temperatures above 500° C. do not bring any further advantages and are therefore generally not used. The process may be carried out under atmospheric pressure or superatmospheric pressure of up to 10 bars. In the latter case, the treatment time can again be reduced. The treatment need not be carried out with pure hydrogen; instead the hydrogen may be diluted with a gas which does not react with the valve metals at the selected temperature, for example with noble gases or carbon dioxide.

However, it is also possible to carry out the treatment according to the invention, with hydrogen, by cathodically polarizing the base, of valve metal, in an aqueous electrolyte. In principle suitable electrolytes are all solutions of salts, acids or bases of which the cation has a deposition potential which, under the selected conditions, is more negative than the deposition potential of hydrogen, ie. of which the cation is not caused to deposit, under the selected conditions, by the presence of the hydrogen. The anion should advantageously be non-oxidizing. In addition, it is advantageous to employ compounds which, when discharged at the anode, do not form any decomposition products which contaminate the electroyte. It is therefore advantageous to employ hydrochloric acid, phosphoric acid or especially sulfuric acid, from amongst the acids, as well as aqueous solutions of the alkali metal salts of these acids and the alkali metal hydroxides, especially sodium hydroxide and potassium hydroxide. The polarization may also be effected in aqueous solutions of hydrofluoric acid or oxalic acid.

The cathodic polarization may be effected at current densities of from 5 to 200 mA/cm$^2$. However, for economic reasons, current densities of 60 mA/cm$^2$ should advantageously not be exceeded. Depending on the selected current density, the duration of treatment may be from 30 minutes to 200 hours, but 200 hours should as a rule not be exceeded, especially for economic reasons. In general, a duration of treatment of up to 10 hours suffices.

Following the treatment, according to the invention, of the valve metal bases, the latter may be provided with electrochemically active coatings in the conventional manner as described, for example, in German Laid-Open Application DOS No. 1,671,422, by applying a coating of a valve metal compound and a noble metal compound onto the base. Such active coatings consist, for example, of a material which is resistant to the electrolyte and to the electrolysis products, and which contains compounds of platinum metals and oxides of metals other than noble metals. Examples are materials comprising at least one oxide, carbide, nitride or sulfide of palladium, platinum, rhodium, iridium, ruthenium or osmium and at least one oxide of a valve metal, in an amount of more than 50 mole percent of the coating material. Of course, other electrochemically active coatings, eg. lead dioxide, vanadium pentoxide or manganese dioxide, may also be applied. The coatings may be applied in any desired conventional manner, eg. by precipitating the particular desired compounds chemically, thermally or electrochemically, or by applying them by plasma spraying or flame spraying. However, care must be taken to ensure that the base is not exposed to an oxygen-containing atmosphere, eg. air, for a lengthy period, eg. more than 2 days, after the treatment according to the invention and before being coated. In contrast, the bases can, after the treatment according to the invention, be stored virtually indefinitely in an inert gas atmosphere.

Electrodes with substantially improved life can be produced by pre-treating the base in accordance with the invention. The potentials remain virtually constant over lengthy periods and the chlorine and oxygen overvoltages are less, so that energy costs can be kept lower.

The electrodes can be employed in electrochemical processes, especially for the electrolytic manufacture of chlorine and alkali metal hydroxides, for the manufacture of chlorates, hypochlorites and persulfates, for electro-organic syntheses and for fuel cells, and the like.

EXAMPLE 1

A titanium expanded metal (No. 2) and a titanium grid (No. 3) each having a surface area of 20 $cm^2$ are cathodically polarized for 1 hour at a current density of $I=0.02$ $A/cm^2$, in 5% strength by weight $H_2SO_4$. A platinum sheet serves as the anode. The electrodes are then rinsed acid-free with water, dried and immediately activated with a solution of $RuCl_3$ in butanol by spraying the soluton onto the titanium base. After drying in air for about 15 minutes, the electrode is thoroughly dried for 10 minutes at 100° C. It is then annealed for 6 minutes in a muffle furnace at 500° C. The process, from spraying to annealing inclusive, is repeated 10 times.

The activating solution has the following composition: 6.2 ml of n-butanol, 1 g of $RuCl_3$, containing 40% by weight of Ru, 0.4 ml of concentrated HCl and 3 ml of butyl titanate $[CH_3(CH_2)_3O]_4Ti$.

The electrodes thus produced are employed as $Cl_2$ anodes in the electrolysis of alkali metal chloride, under actual operating conditions.

The operating conditions are:

brine input concentration $C_{NaCl}=320$ g/l, t=80° C., $I=10$ $kA/m^2$;

cathode: flowing mercury.

For comparison, an electrode coated in the same manner with $RuCl_3$ solution is employed, the difference being that the titanium base (No. 1), again having a surface area of 20 $cm^2$, is beforehand treated in the conventional manner merely by blasting with quartz sand and pickling in 3% strength by weight hydrofluoric acid solution, before the electrocatalytic coating is applied as described above.

The life of the electrodes pre-treated with hydrogen is 420 days, whilst the life of the comparison electrode is only 220 days. If zirconium or tantalum bases are used, the same increase in life over conventionally treated bases is found.

The quotient u/i.d Ω/mm is a measure of the change of resistance at the electrode. In this equation, u=cell voltage in volts, i=current flowing, in amperes, d=distance of the anode from the cathode in mm. In the case of the electrodes pre-treated with hydrogen, the quotient u/i.d is initially 0.025 and 0.015 Ω/mm respectively, and after 300 days is still 0.033 and 0.02 Ω/mm respectively, whilst in the case of the comparison electrode the quotient is initially 0.06 and after 200 days is greater than 0.1 Ω/mm.

EXAMPLE 2

A titanium grid having a surface area of 20 $cm^2$ is placed in a gas-tight oven, which is heated to 400° C. whilst being flushed with argon. The argon is then replaced by hydrogen and the temperature of 400° C. is maintained for 30 minutes. The oven subsequently cools, again whilst constantly being flushed with hydrogen, until room temperature is reached. During the treatment, the partial pressure of hydrogen is 760 mm Hg. After it has cooled, the electrode base is coated with a solution of $RuCl_3$ in butanol, as described in Example 1, and is tested under the same conditions.

The life of the electrode is more than 320 days; the quotient Ω/i.d is initially 0.015 Ω/mm and rises after 240 days to merely 0.016 Ω/mm.

Table 1 below again illustrates the results of Examples 1 and 2.

TABLE 1

| Electrode | $H_2$ pre-treatment | | Life | $\frac{U}{id}$ [ω/mm] | | | | |
|---|---|---|---|---|---|---|---|---|
| No. | eletrochemical | thermal | [days] | start | 100 days | 200 days | 300 days | x days |
| 1 | none | | 220 | 0.06 | 0.04 | 0.1 | | |
| 2 | 0.02 $A/cm^2$ 1 hour | | >420 | 0.025 | 0.03 | 0.032 | 0.033 | 420 / 0.035 |
| 3 | 0.02 $A/cm^2$ 1 hour | | >420 | 0.015 | 0.018 | 0.018 | 0.02 | 0.022 |
| 4 | | 400° C. 760 mm Hg 300 min. | >320 | 0.015 | 0.015 | 0.016 | 320 days / 0.026 | |

EXAMPLE 3

Two titanium bodies (No. 6+7) each having a surface area of 3.5 $cm^2$ cathodically polarized for 8 days at a current density of $I=0.15$ $A/cm^2$ in 5% strength by weight sulfuric acid, using a platinum sheet as the anode. The bodies are then rinsed acid-free with water, and dried, and an $MnO_2/PbO_2$ active coating is applied.

The $MnO_2/PbO_2$ active coating is produced as follows:

$Mn(NO_3)_2.6H_2O$ and $Pb(NO_3)_2$ in the molar ratio of 1:1 are fused together at 100° C. and a thin coating of the material is applied to the pre-treated titanium bodies by means of a brush, after which the bodies are heated in an oven at 150° C. for 1 hour. After they have cooled outside the oven, any oxide which does not adhere firmly is removed mechanically. The coating process is repeated 10 times.

A titanium body (No. 5) which has only been pickled in 3% strength by weight hydrofluoric acid is provided with an $MnO_2/PbO_2$ active coating as described and then serves as the comparison electrode.

The electrodes thus produced are employed as oxygen anodes in 5% strength by weight sulfuric acid at 25° C., with graphite electrodes as the cathodes. The current density under operating conditions is 15 $A/dm^2$. The life of the $MnO_2/PbO_2$ electrodes which have been pretreated with hydrogen is greater than 270 days, whilst the life of the comparison electrode is only 100 days. The potential characteristics exhibit good constancy over the life of the electrode, the details being as follows: the potential of the electrodes pre-treated with hydrogen is initially, at a current density of $I=15$ $A/dm^2$, 2.36 V and 2.24 V respectively; after 270 days the values are 2.38 V and 2.40 V respectively; the value for the comparison electrode is initially 2.01 V, but after only 100 days already exceeds 3.0 V.

EXAMPLE 4

Two titanium bodies having a surface area of 3.5 $cm^2$ (No. 8+9) are subjected to a thermal pre-treatment with hydrogen as described in Example 2 and are then immediately provided with an $MnO_2/PbO_2$ active coating as in Example 3, and tested under the same conditions as in Example 3.

The life of the electrodes is more than 210 days; the potentials are initially, at a current density of I=15 A/dm², 2.93 V and 2.68 V respectively, whilst after 210 days they are 2.78 V and 2.74 V respectively.

Table 2 below once again summarizes the results of Examples 3 and 4.

TABLE 2

| Electrode No. | $H_2$ pre-treatment electrochemical | $H_2$ pre-treatment thermal | Life [days] | $H_{U15\ A/dm2}$[V] initially | 100 days | 200 days | x days |
|---|---|---|---|---|---|---|---|
| 5 | none | | 100 | 2.01 | >3.0 | | |
| 6 | 8 days 0.15 A/cm² | | 270 | 2.36 | 2.41 | 2.35 | 270 days 2.38 |
| 7 | " | | 270 | 2.24 | 2.39 | 2.38 | 2.40 |
| 8 | | 400° C. 760 mm Hg 30 min. | 210 | 2.93 | 2.77 | 2.78 | 210 days 2.78 |
| 9 | | " | 210 | 2.68 | 2.72 | 2.74 | 2.74 |

EXAMPLE 5

A titanium body (No. 11) having a surface area of 3.5 cm² is cathodically polarized, as described in Example 1, for 1 hour at a current density of I=0.02 A/cm², rinsed acid-free with water, dried and immediately provided with an active coating of $MnO_2/V_2O_5$.

Production of the $MnO_2/V_2O_5$ coating:

$Mn(NO_3)_2.6H_2O$ and $V_2O_5$ are mixed in the molar ratio of 9:1 and the mixture is fused at 100° C. A thin coating of the melt is applied by means of a brush to the hydrogen-pre-treated bodies and is then heated for one hour at 150° C. After cooling, the loose oxide particles are removed mechanically. This process is repeated 10 times.

A further titanium body (No. 10) is pickled in 3% strength by weight hydrofluoric acid and is then coated in the same manner with $MnO_2/V_2O_5$. This body serves as the comparison electrode. The electrodes are tested as oxygen electrodes, by the method described in Example 3. The life of the hydrogen-pre-treated electrodes is greater than 210 days whilst that of the comparison electrode is only 102 days. In the case of the electrode produced according to the invention, the potential rises, at a current density of I=15 A/dm², in 210 days from 2.14 V to only 2.21 V, whilst in the case of the comparison electrode it rises from 2.05 V to 3.0 V after 102 days.

EXAMPLE 6

A titanium body (No. 12) having a surface area of 3.5 cm² is thermally treated with hydrogen by the method described in Example 2 and then immediately provided with an active coating of $MnO_2/V_2O_5$, as described in Example 5, and tested as an oxygen electrode. The life is greater than 190 days and the potential rises, at a current density of I=15 A/dm², from 2.26 V to only 2.31 V after 190 days.

Table 3 below again illustrates the results of Examples 5 and 6.

TABLE 3

| Electrode No. | $H_2$ pre-treatment electrochemical | $H_2$ pre-treatment thermal | Life [days] | $H_{U1.5\ A/dm2}$ [V] initially | 100 days | 200 days | |
|---|---|---|---|---|---|---|---|
| 10 | none | | 102 | 2.05 | 2.2 | 102 days 3.0 | |
| 11 | 1 hour 0.02 A/cm² | | >210 | 2.14 | 2.19 | 2.21 | 210 days 2.21 |
| 12 | | 400° C. 760 mm Hg 30 min. | >190 | 2.26 | 2.28 | 190 days 2.31 | |

EXAMPLE 7

A titanium body (No. 14) is cathodically polarized by the method described in Example 1, but for 6.5 days at I=0.15 A/cm². Another titanium body (No. 15) like that described in Example 2, is thermally treated with hydrogen. Both bodies are then provided with an active coating of $MnO_2/PbO_2$. The current/voltage characteristics of the electrodes in 5% strength by weight sulfuric acid at 25° C. are followed in a potentiodynamic circuit. The voltage/time gradient ΔU/Δt is 200 mV/min. The potential at a current density of I=1.5 A/dm² serves as the comparison value.

EXAMPLE 8

Two titanium bodies (No. 17 and 18) are treated as described in Example 7, but are provided with an active coating of $MnO_2/V_2O_5$, and the current-voltage characteristics are then tested in the same manner as in Example 7. Here again, a comparison electrode which has not been pre-treated with hydrogen but is coated with $MnO_2/V_2O_5$ is employed.

The potentials $H_{U\ 1.5}$ (=potential of the anode at a current density of 1.5 A/dm², based on the standard hydrogen potential in volt), are listed in Table 4 below.

TABLE 4

| System | Electrode No. | $H_2$ pre-treatment electrochemical | $H_2$ pre-treatment thermal | $H_{U1.5\ .\ A}$ mV |
|---|---|---|---|---|
| $MnO_2$ | 13 | | none | 1,670 |
| | 14 | 6.5 days 0.15 A | | 1,290 |
| $PbO_2$ | 15 | | 400° C. 760 mm Hg 30 min. | 1,320 |
| $MnO_2$ | 16 | | none | 2,490 |
| | 17 | 6.5 days 0.15 A | | 2,030 |
| $V_2O_5$ | 18 | | 400° C. 760 mm Hg 30 min. | 2,140 |

It may be seen from the Table that the oxygen overvoltage is reduced by 350 and 380 mV respectively in the case of the electrodes coated with $MnO_2/PbO_2$, and by 460 and 350 mV, respectively, in the case of the electrodes coated with $MnO_2/V_2O_5$.

We claim:

1. A process for manufacture of an electrode having an electrode base of a valve metal with an electrochemically active coating thereon, which comprises treating said electrode base of a valve metal with hydrogen in a hydrogen atmosphere at from 20° to 500° C., and applying to the treated base an electrochemically active coating of at least one oxide, carbide, nitride or sulfide of palladium, platinum, rhodium, iridium, ruthenium or osmium and at least one oxide of a valve metal, in an amount of more than 50 mole percent of the coating material.

2. A process as claimed in claim 1, wherein the treatment is carried out at a pressure of from atmospheric up to 10 bars.

3. A process as claimed in claim 1, wherein after the treatment with hydrogen the base is coated with the electrochemically active coating without allowing it to be exposed to an oxygen-containing atmosphere for a period of more than 2 days.

* * * * *